US009670733B1

(12) United States Patent
Ng

(10) Patent No.: US 9,670,733 B1
(45) Date of Patent: Jun. 6, 2017

(54) SUBSEA MULTIBORE DRILLING AND COMPLETION SYSTEM

(71) Applicant: GE Oil & Gas Pressure Control LP, Houston, TX (US)

(72) Inventor: Hoong Man Ng, Singapore (SG)

(73) Assignee: GE Oil & Gas Pressure Control LP, Houston, TX (US)

( * ) Notice: Subject to any disclaimer, the term of this patent is extended or adjusted under 35 U.S.C. 154(b) by 0 days.

(21) Appl. No.: 15/002,754

(22) Filed: Jan. 21, 2016

(51) Int. Cl.

| | |
|---|---|
| ***E21B 7/12*** | (2006.01) |
| ***E21B 19/00*** | (2006.01) |
| ***E21B 43/30*** | (2006.01) |
| ***E21B 33/12*** | (2006.01) |

(52) U.S. Cl.
CPC ..... *E21B 7/12* (2013.01); *E21B 19/002* (2013.01); *E21B 33/12* (2013.01); *E21B 43/30* (2013.01)

(58) Field of Classification Search
CPC ..... E21B 7/12; E21B 7/128; E21B 19/002; E21B 33/12; E21B 41/08; E21B 43/30
See application file for complete search history.

(56) References Cited

U.S. PATENT DOCUMENTS 3,601,189 A * 8/1971 Weiss ..... E21B 7/12 166/356
5,129,459 A * 7/1992 Breese ..... E21B 23/002 137/625.46
5,244,312 A * 9/1993 Wybro ..... E02B 17/00 166/338
5,330,007 A * 7/1994 Collins ..... E21B 7/043 166/313
5,458,199 A * 10/1995 Collins ..... E21B 7/043 166/313
5,526,882 A * 6/1996 Parks ..... E21B 41/08 166/339
5,560,435 A * 10/1996 Sharp ..... E21B 7/043 166/313
5,655,602 A * 8/1997 Collins ..... E21B 7/043 166/313
5,685,373 A * 11/1997 Collins ..... E21B 7/043 125/5

(Continued)

FOREIGN PATENT DOCUMENTS

CN 101787856 A 7/2010

OTHER PUBLICATIONS

G.J. Collins, et al., Field Testing a Downhole Multiwell Drilling Template: A Unique Approach to Individually Drill, Case, and Complete Two Separate Wells From One, Offshore Technology Conference, May 2-5, 1994, Houston, TX.

*Primary Examiner* — Matthew R Buck
(74) *Attorney, Agent, or Firm* — Hogan Lovells US LLP

(57) ABSTRACT

Systems and methods for drilling multiple wells include a landing template, the landing template having at least two through bores. Each through bore extends from a first face of the landing template to an opposite second face of the landing template. A skirt conductor is secured to the landing template, the skirt conductor operable to be driven into a sea floor so that the landing template is proximate to a mudline. A bore separator guide has a drill bit guide sized to register with one of the through bores. The bore separator guide is moveable to align with each of the at least two through bores one at a time.

17 Claims, 3 Drawing Sheets

(56) References Cited

U.S. PATENT DOCUMENTS

| | | | | | |
|---|---|---|---|---|---|
| 5,865,260 | A * | 2/1999 | Jackson | E21B 7/043 | 166/358 |
| 6,145,596 | A * | 11/2000 | Dallas | E21B 19/086 | 166/379 |
| 6,736,212 | B2 * | 5/2004 | Liew | E21B 33/047 | 166/313 |
| 7,066,267 | B2 * | 6/2006 | Hall | E21B 7/061 | 166/313 |
| 7,100,693 | B2 * | 9/2006 | Collins | E21B 41/0035 | 166/308.1 |
| 7,264,067 | B2 * | 9/2007 | Glaser | E21B 7/061 | 166/313 |
| 8,056,251 | B1 * | 11/2011 | Oglesby | E21B 7/04 | 33/562 |
| 8,573,307 | B2 * | 11/2013 | Moksvold | E21B 17/01 | 166/345 |
| 8,857,523 | B2 * | 10/2014 | Lau | E21B 17/18 | 166/352 |
| 8,881,828 | B2 * | 11/2014 | Strand | E21B 33/038 | 166/339 |
| 8,960,311 | B2 * | 2/2015 | Ong | E21B 33/047 | 166/378 |
| 2010/0126729 | A1 * | 5/2010 | Tunget | E21B 23/002 | 166/313 |
| 2015/0372470 | A1 * | 12/2015 | Strand | E21B 43/017 | 174/37 |

* cited by examiner

SUBSEA MULTIBORE DRILLING AND COMPLETION SYSTEM

BACKGROUND OF THE DISCLOSURE

1. Field of the Disclosure

The present disclosure relates in general to drilling hydrocarbon development and production wells, and in particular to drilling multiple wells through a single template.

2. Description of Related Art

There exist small pockets of reservoirs of hydrocarbons that are located in shallow waters, such as up to 100 m, that are considered marginally cost effective. If these reservoirs are attempted to be developed, for example with a full subsea development system or with a dedicated platform, the economics would not favor the development and production of the hydrocarbons of the reservoirs. Some of these reservoirs might be economically feasible if they could be developed in a lower cost manner.

SUMMARY OF THE DISCLOSURE

Embodiments described herein provide systems and methods for exploring and producing multiple wells in shallow water marginal fields or near existing production facilities without the need to build an annex platform, without the use of an expensive semi-submersible drilling rig, and without the need for a full subsea development. Because the activities are taking place in shallow water, divers can assist in the operations and the use of costly remotely operated vehicles can be avoided.

Embodiments disclosed herein allow the operator to drill, explore and suspend two or more wells simultaneously with the use of a jack up rig or tender assist drilling rig and to complete each well with a mudline tree. The system for drilling multiple wells disclosed herein allows the operator the ability to drill and appraise subsea close proximity reservoirs quickly and effectively in a single drilling conductor with the ability to tie any subsea production conduits back to an existing platform.

In an embodiment of the current disclosure, a system for drilling multiple wells includes a landing template, the landing template having at least two through bores. Each through bore extends from a first face of the landing template to an opposite second face of the landing template. A skirt conductor is secured to the landing template. The skirt conductor is operable to be driven into a sea floor so that the landing template is proximate to a mudline. A bore separator guide has a drill bit guide sized to register with one of the through bores. The bore separator guide is moveable to align with each of the at least two through bores, one at a time.

In an alternate embodiment of the current disclosure, a system for completing multiple wells includes a landing template, the landing template having at least two through bores. Each through bore extends from a first face of the landing template to an opposite second face of the landing template. A skirt conductor is secured to the landing template. The skirt conductor is driven into a sea floor so that the landing template is proximate to a mudline. A bore separator guide has a drill bit guide sized to register with one of the through bores. The bore separator guide is moveable to align with each of the at least two through bores one at a time. A riser conductor stub extends from the landing template in a direction opposite the skirt conductor. A drilling riser is sealingly connected to the riser conductor stub. The drilling riser is sized to accommodate a drill string for guidance through the drill bit guide when the drill bit guide is registered with one of the through bores.

In yet another embodiment of this disclosure, a method for drilling multiple wells includes providing a landing template, the landing template having at least two through bores. Each through bore extends from a first face of the landing template to an opposite second face of the landing template. The landing template further has a skirt conductor secured to the landing template. The skirt conductor is driven into a sea floor so that the landing template is proximate to the mudline. A bore separator guide is aligned so that a drill bit guide of the bore separator guide registers with one of the through bores. A first well is drilled through the drill bit guide. The bore separator guide is moved so that the drill bit guide registers with another one of the through bores and second well is drilled through the drill bit guide.

BRIEF DESCRIPTION OF THE DRAWINGS

So that the manner in which the features, advantages and objects of the disclosure, as well as others which will become apparent, are attained and can be understood in more detail, more particular description of embodiments of the disclosure briefly summarized above may be had by reference to the embodiment thereof which is illustrated in the appended drawings, which drawings form a part of this specification. It is to be noted, however, that the drawings illustrate only certain embodiments of the disclosure and is therefore not to be considered limiting of its scope as the disclosure may admit to other equally effective embodiments.

DETAILED DESCRIPTION OF THE DISCLOSURE

The system and method of the present disclosure will now be described more fully hereinafter with reference to the accompanying drawings which illustrate embodiments of the disclosure. The systems and methods of this disclosure may, however, be embodied in many different forms and should not be construed as limited to the illustrated embodiments set forth herein. Rather, these embodiments are provided so that this disclosure will be thorough and complete and will fully convey the scope of the disclosure to those skilled in the art. Like numbers refer to like elements throughout.

Figure 1:
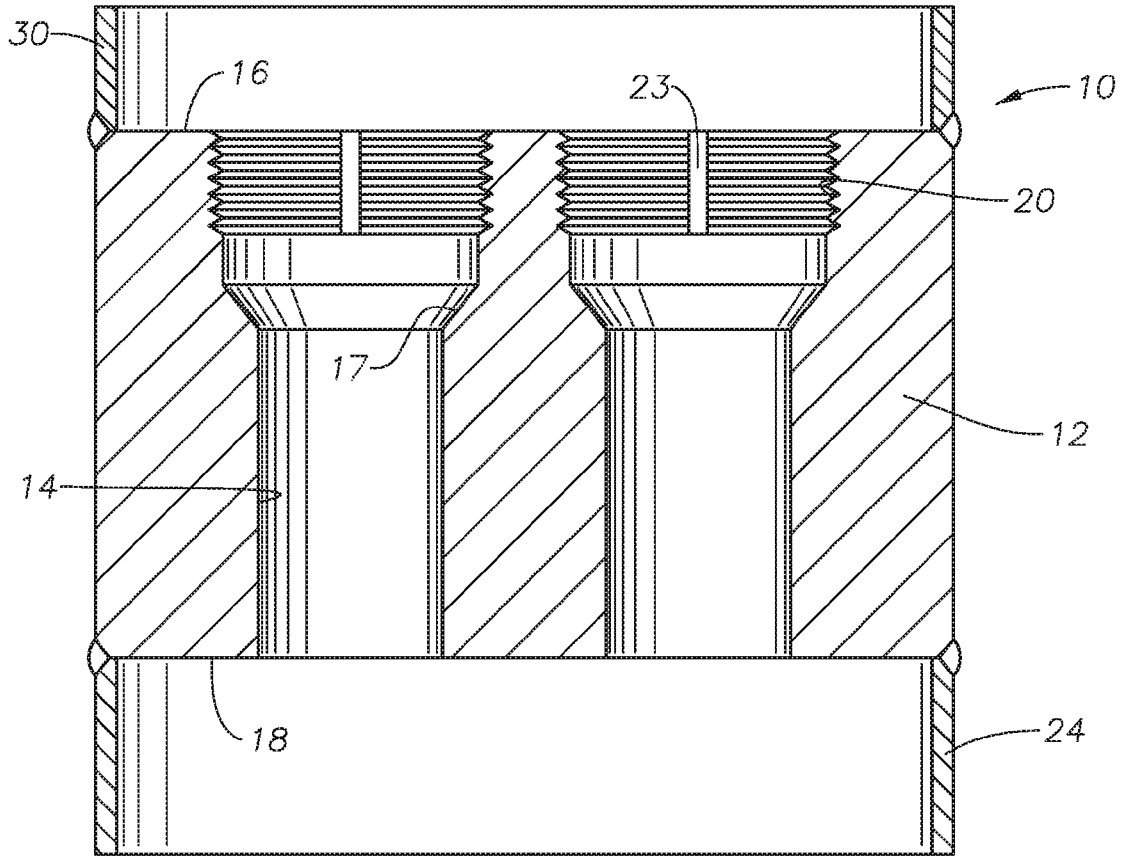
FIG. 1 is a section view of a template assembly of a system for drilling multiple wells, in accordance with an embodiment of this disclosure.

Referring to FIG. 1, template assembly 10 includes landing template 12. Landing template 12 has at least two through bores 14. As an example, landing template 12 can have two to five through bores 14 and can have an outer diameter in a range of thirty six to fifty six inches. Through bore 14 extends from a first face 16 of landing template 12 to an opposite second face 18 of landing template 12. Through bore 14 can be generally cylindrical in shape. On an inner diameter of through bore 14, is a hanger profile 17. Hanger profile 17 is sized and shaped to support the weight of a subsea mudline hanger. As an example, casing hanger 19 (FIG. 3) can be landed on, and locked to, hanger profile 17. Hanger profile 17 can include, for example, an upward facing sloped annular shoulder for supporting a mating shoulder of the hanger.

Through bore 14 can include bore threads 20 on an inner diameter of through bore 14 proximate to first face 16 of landing template 12. Bore threads 20 can be used to secure threaded members into through bore 14. As an example, suspension cap 22 (FIG. 2) can be threaded into through bore 14. One or more alignment slots 23 can be located within the inner diameter of through bore 14. Alignment slots 23 can extend through bore threads 20, creating a gap in bore threads 20. Alignment slot 23 can be used as an alignment and anti-rotation feature for members that are extended into through bore 14.

Figure 3:
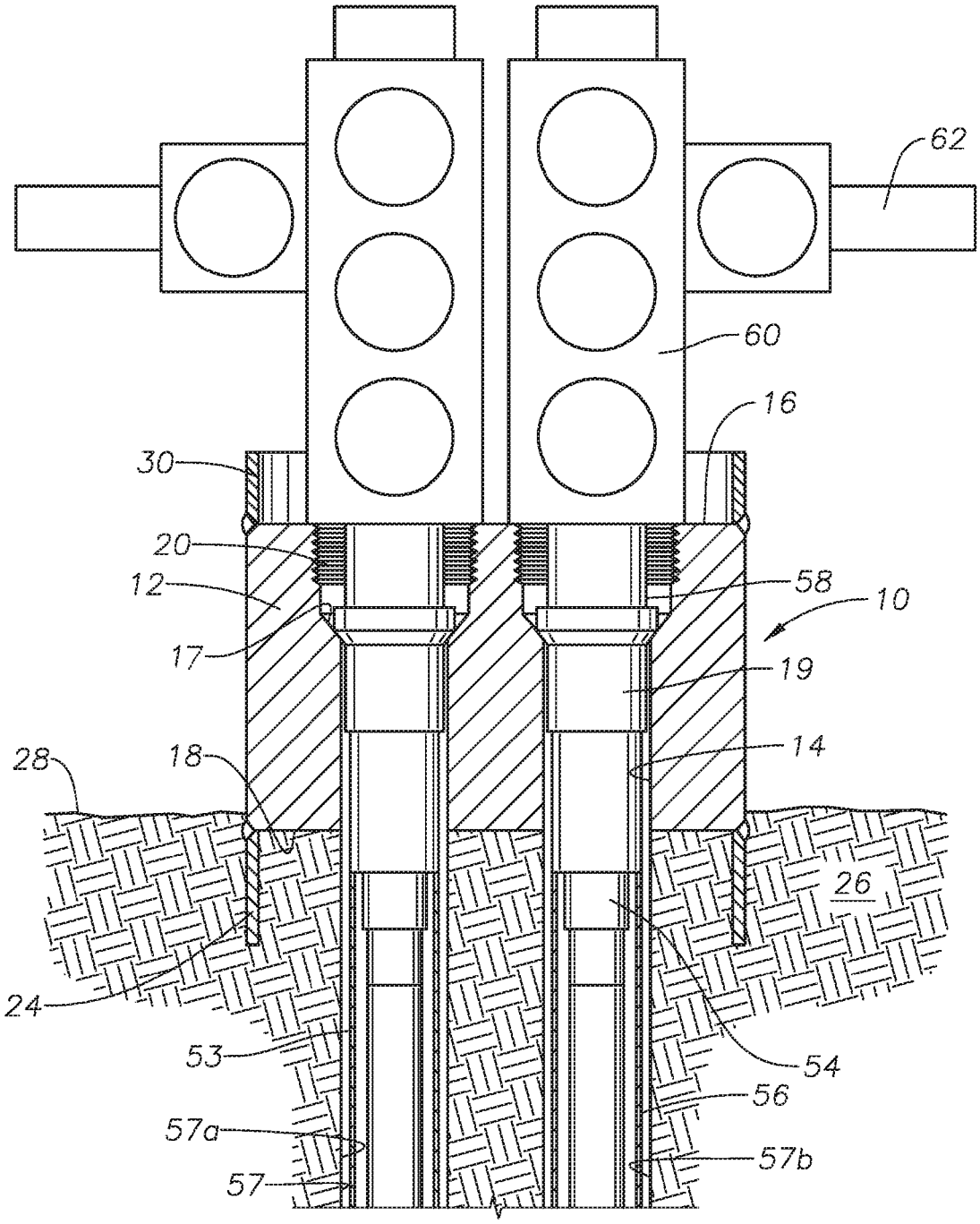
FIG. 3 is a schematic section view of a system for drilling multiple wells showing completed wells, in accordance with an embodiment of this disclosure.

Template assembly 10 can have skirt conductor 24 that is secured to landing template 12. As an example, an end of skirt conductor 24 can be welded to landing template 12 proximate to second face 18. Skirt conductor 24 can be a tubular member with a sidewall that aligns with an outer diameter of landing template 12. Skirt conductor 24 is operable to be driven into a sea floor 26 so that landing template 12 is proximate to mudline 28 (FIG. 3). Skirt conductor 24 can help to support and stabilize landing template 12 relative to sea floor 26.

Template assembly 10 can further include riser conductor stub 30 that is secured to landing template 12. As an example, an end of riser conductor stub 30 can be welded to landing template 12 proximate to first face 16. Riser conductor stub 30 can extend from landing template 12 in a direction opposite skirt conductor 24. Riser conductor stub 30 can be a tubular member with a sidewall that aligns with an outer diameter of landing template 12. Riser conductor stub 30 can provide a surface for connecting drilling riser 32 (FIG. 2) to template assembly 10.

Figure 2:
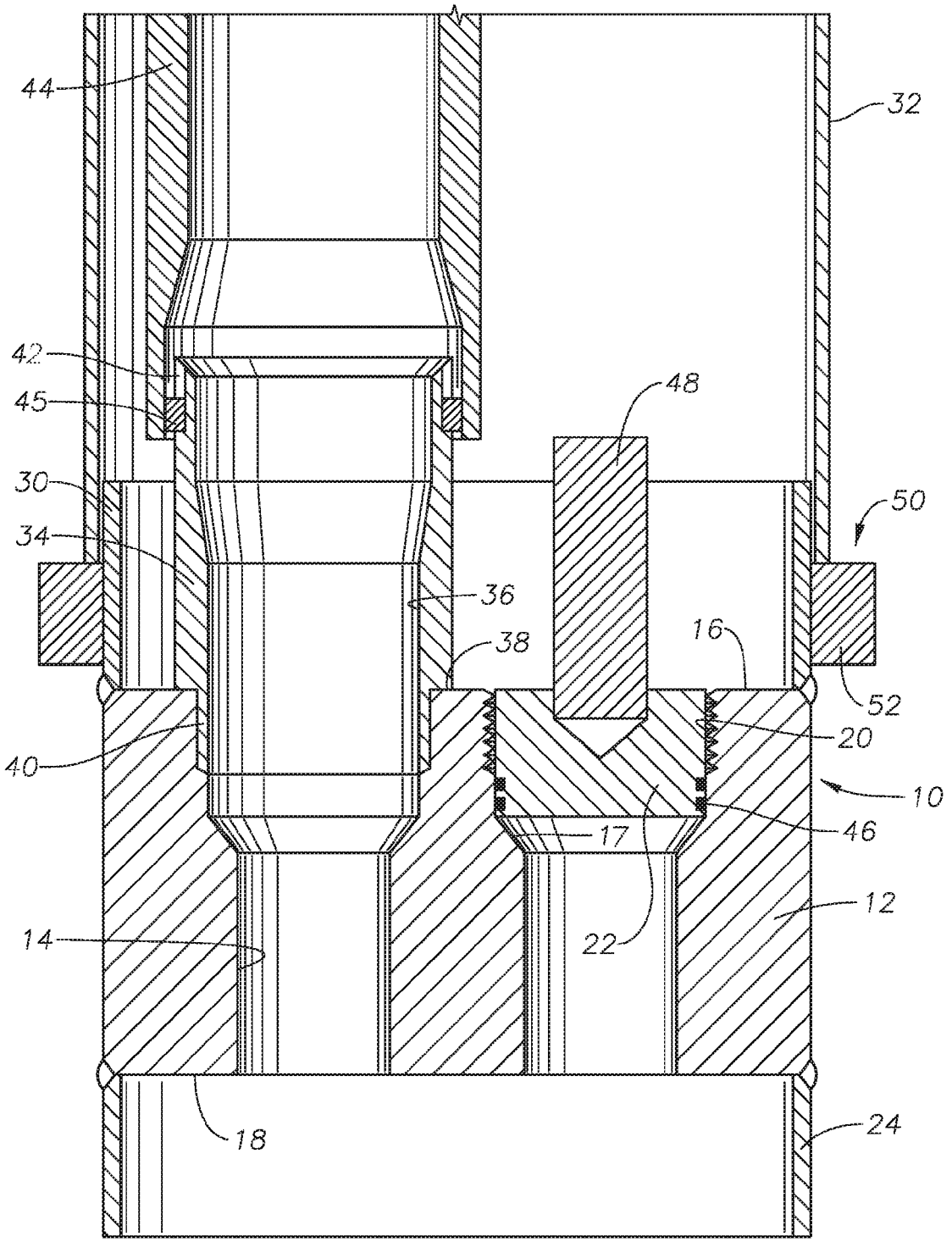
FIG. 2 is a schematic section view of a system for drilling multiple wells, in accordance with an embodiment of this disclosure.

Looking at FIG. 2, bore separator guide 34 can be supported by landing template 12. Bore separator guide 34 can be a generally cylindrical member and can have a guide feature such as single inner bore that defines drill bit guide 36. Drill bit guide 36 is sized to register with through bore 14. Drill bit guide 36 can register with one of the through bores 14. Bore separator guide 34 is moveable so that drill bit guide 36 can register with each of the through bores 14, one at a time, in turn.

Bore separator guide 34 can have a generally annular shoulder 38 that mates with first face 16. Extending past shoulder 38 is one or more alignment members 40. Alignment member 40 can be an elongated member that is sized to engage alignment slot 23 when bore separator guide 34 is lowered onto landing template 12. The engagement of alignment member 40 and alignment slot 23 assists in aligning drill bit guide 36 with through bore 14 and in preventing relative rotation between bore separator guide 34 and landing template 12.

At an end of bore separator guide 34 from alignment member 40, bore separator guide 34 can have an engagement profile 42. Engagement profile 42 can be used by installation tool 44 for lowering bore separator guide 34 onto landing template 12, for moving separator guide from one through bore 14 to another through bore 14, and for retrieving bore separator guide 34. As an example, engagement profile 42 can be a "J" slot and installation tool 44 can have protrusions 45 for engaging engagement profile 42. In alternate embodiments, other known tool profiles can be used to engage bore separator guide 34 with installation tool 44.

Suspension cap 22 can be located in one of the through bores 14 that is not aligned with drill bit guide 36. As an example, suspension cap 22 can have external threads that mate with bore threads 20 to releasably secure suspension cap 22 in through bore 14. Suspension cap 22 can blank off through bore 14 so that fluids and pressure cannot move past landing template 12 by way of through bore 14. Suspension cap 22 can sealingly engage the inner diameter of through bore 14 with seals 46, or with other known sealing means. Suspension cap 22 can be engaged with drill pipe 48 to facilitate the insertion and removal of suspension cap 22 into and out of through bore 14.

Drilling riser 32 can be a lower pressure drilling riser. Drilling riser 32 is sized to accommodate a drill string that passes through drill bit guide 36 when the drill bit guide 36 is registered with one of the through bores 14. Drilling riser 32 can be secured and connected to template assembly 10 with a connection assembly 50. Connection assembly 50 can be a quick connect type assembly that has a hydraulically expandable elastomer packer element that can, as an example, provide a quick connect and disconnect for low pressure drilling without the need for a high torque disconnect. Connection assembly 50 can seal between the outer diameter of riser conductor stub 30 and the inner diameter of drilling riser 32. As an example, connection assembly 50 can include a packer assembly 52 operable to seal between the outer diameter of riser conductor stub 30 and the inner diameter of drilling riser 32. Drilling riser 32 can carry packer assembly 52 and can extend over and circumscribe a portion of riser conductor stub 30 and packer assembly 52 can be an overshot type packer that can then be inflated or energized to form the seal between the outer diameter of riser conductor stub 30 and the inner diameter of drilling riser 32.

Looking at FIG. 3, template assembly 10 is shown as part of a hydrocarbon development completion. Casing hanger 19 is landed on, and locked to, hanger profile 17. An outer casing 53 can be suspended from casing hanger 19. Casing hanger 19 can be a mudline type hanger. A subsequent casing hanger 54 can be supported by casing hanger 19. An inner casing 56 can be suspended from subsequent hanger 54. Both inner casing 56 and outer casing 53 extend into the well 57. Production conduit 58 extends to tree 60. Tree 60 is a mudline or marine tree and can allow for the drilling and completion of shallow water subsea well 57 from a standard jack-up drilling rig or tender assist drilling unit.

Tieback lines 62 extend from tree 60 to existing production facilities so that there is no requirement to build a new surface facility or a full subsea development. Tieback lines 62 carry produced fluids from well 57 to the production facilities.

In an example of operation, template assembly 10 is lowered to sea floor 26. Skirt conductor 24 of template assembly 10 is driven into sea floor 26 until landing template 12 is proximate to mudline 28. Drilling riser 32 can be sealingly connected to template assembly 10. Connection assembly 50 can be used to seal between the outer diameter of riser conductor stub 30 and the inner diameter of drilling riser 32. Drilling riser 32 can be lowered over the upper end of riser conductor stub 30 and packer assembly 52 can be an overshot type packer that can then be inflated or energized to form the seal between the outer diameter of riser conductor stub 30 and the inner diameter of drilling riser 32. After drilling riser 32 is sealingly connected to riser conductor stub 30, the seal formed by packer assembly 52 can be hydraulically tested to ensure the integrity of the seal between drilling riser 32 and riser conductor stub 30.

Bore separator guide 34 is aligned so that drill bit guide 36 of bore separator guide 34 registers with one of the through bores 14. Bore separator guide 34 can be lowered onto landing template 12 with installation tool 44. As an example, protrusions 45 of installation tool 44 can mate with engagement profile 42. When bore separator guide 34 is landed on landing template 12, the engagement of alignment member 40 and alignment slot 23 assists in aligning drill bit guide 36 with through bore 14 and in preventing relative rotation between bore separator guide 34 and landing template 12. The engagement of alignment member 40 and alignment slot 23 retains the relative position of bore separator guide 34 and landing template 12 as installation tool 44 is rotated to disengage protrusions 45 from engagement profile 42.

Drill pipe 48 with a drill bit attached can then drill a first well 57*a* through drill bit guide 36. Outer casing 53 and casing hanger 19 can be landed within, and supported by, hanger profile 17. Drill pipe 48 with a drill bit attached can then further drill first well 57*a* through casing hanger 19 and then inner casing 56 and subsequent hanger 54 can be landed within, and supported by, casing hanger 19. Suspension cap 22 can then be threaded into through bore 14 with drill pipe 48 in order to prevent any fluids from passing into, or out of, first well 57*a* through template assembly 10.

Installation tool 44 can then be used to move bore separator guide 34 so that drill bit guide 36 registers with another one of the through bores 14. Drill pipe 48 with a drill bit attached can then drill a second well 57*b* through drill bit guide 36. Outer casing 53 and casing hanger 19 can be landed within, and supported by, hanger profile 17. Drill pipe 48 with a drill bit attached can then further drill second well 57*b* through casing hanger 19 and then inner casing 56 and subsequent hanger 54 can be landed within, and supported by, casing hanger 19. Suspension cap 22 can then be threaded into through bore 14 with drill pipe 48 in order to prevent any fluids from passing into, or out of, second well 57*b* through template assembly 10. This process can be repeated to drill further wells through other through bores 14.

Mudline trees 60 can be lowered onto landing template 12 at the mudline. Each mudline tree 60 can be in fluid communication with one of the wells 57. Tieback lines 62 extend from tree 60 so that fluids produced from wells 57 can be delivered to existing production facilities and there is no requirement to build a new surface facility or a full subsea development. Each of the operations of the methods disclosed herein can be performed from a standard jack-up drilling rig or tender assist drilling unit, without the need for a semi-submersible drilling rig or other more costly rig, and with diver assistance without the need for a more costly remotely operated vehicle.

The terms "vertical", "horizontal", "upward", "downward", "above", and "below" and similar spatial relation terminology are used herein only for convenience because elements of the current disclosure may be installed in various relative positions.

While embodiments of the disclosure have been shown or described in only some of their forms, it should be apparent to those skilled in the art that it is not so limited, but is susceptible to various changes without departing from the scope of the disclosure.

What is claimed is:

1. A system for drilling multiple wells, the system comprising:

a landing template, the landing template having at least two through bores, each through bore extending from a first face of the landing template to an opposite second face of the landing template;

a skirt conductor secured to the landing template, the skirt conductor operable to be driven into a sea floor so that a portion of the landing template is located at a mudline;

a bore separator guide having a drill bit guide sized to register with one of the through bores, the bore separator guide being moveable to align with each of the at least two through bores one at a time;

a riser conductor stub, the riser conductor stub extending from the landing template in a direction opposite the skirt conductor; and a packer assembly, the packer assembly operable to seal between an outer diameter of the riser conductor stub and an inner diameter of a drilling riser.

2. The system according to claim 1, further comprising a quick connector operable to make-up a connection between the riser conductor stub and the drilling riser.

3. The system according to claim 1, further comprising a suspension cap located in at least one of the through bores, the at least one of the through bores being out of alignment with the bore separator guide.

4. The system according to claim 1, wherein the at least two through bores have an internal hanger profile shaped to support and lock a casing hanger.

5. A system for completing multiple wells, the system comprising:

a landing template, the landing template having at least two through bores, each through bore extending from a first face of the landing template to an opposite second face of the landing template;

a skirt conductor secured to the landing template, the skirt conductor driven into a sea floor so that a portion of the landing template is located at a mudline;

a bore separator guide having a drill bit guide sized to register with one of the through bores, the bore separator guide being moveable to align with each of the at least two through bores one at a time;

a riser conductor stub extending from the landing template in a direction opposite the skirt conductor; and a drilling riser sealingly connected to the riser conductor stub, the drilling riser sized to accommodate a drill string that passes through the drill bit guide when the drill bit guide is registered with one of the through bores.

6. The system according to claim 5, further comprising a packer assembly sealing between the drilling riser and the riser conductor stub.

7. The system according to claim 5, further comprising a quick connector connecting the drilling riser to the riser conducting stub, and wherein the drilling riser is a lower pressure riser.

8. The system according to claim 5, further comprising a casing hanger landed within one of the at least two through bores, the casing hanger being supported by a hanger profile located on an internal diameter of the one of the at least two through bores.

9. The system according to claim 5, further comprising a suspension cap located within one of the at least two through bores, the one of the at least two through bores being out of alignment with the bore separator guide.

10. A method for drilling multiple wells, the method comprising:

providing a landing template, the landing template having at least two through bores, each through bore extending from a first face of the landing template to an opposite second face of the landing template, the landing template further having a skirt conductor secured to the landing template;

driving the skirt conductor into a sea floor so that a portion of the landing template is located at a mudline;

aligning a bore separator guide so that a drill bit guide of the bore separator guide registers with one of the through bores;

drilling a first well through the drill bit guide;

connecting a drilling riser to a riser conductor stub that extends from the landing template in a direction opposite the skirt conductor before drilling the first well; and moving the bore separator guide so that the drill bit guide registers with another one of the through bores and drilling a second well through the drill bit guide.

11. The method according to claim 10, further comprising before drilling the first well, energizing a packing assembly to form a seal between the drilling riser and the riser conductor stub that extends from the landing template in the direction opposite the skirt conductor.

12. The method according to claim 10, wherein the drilling riser is a low pressure drilling riser, and wherein the step of connecting the drilling riser to the riser conductor stub includes connecting the drilling riser to the riser conductor stub with a quick connector.

13. The method according to claim 10, further comprising after connecting the drilling riser to the riser conductor stub, hydraulically testing a seal between the drilling riser and the riser conductor stub.

14. The method according to claim 10, wherein the step of drilling the first well through the drill bit guide includes a casing hanger on a hanger profile located on an inner diameter of the one of the through bores and drilling through the casing hanger.

15. The method according to claim 10, further comprising before drilling the second well through the drill bit guide, inserting a suspension cap into the one of the through bores.

16. The method according to claim 10, further comprising after drilling the first well, locating a mudline tree at the mudline, the mudline tree being in fluid communication with the first well.

17. The method according to claim 16, where in the step of drilling the first well through the drill bit guide and the step of locating the mudline tree at the mudline is performed from a jack-up rig.

* * * * *